US007228678B2

(12) United States Patent
Wilson

(10) Patent No.: US 7,228,678 B2
(45) Date of Patent: Jun. 12, 2007

(54) EQUESTARIAN TATTLETALE RIDER HAND TRAINING DEVICE

(76) Inventor: Stacy Wilson, 4404 Danville Rd., Brandywine, MD (US) 20613

( * ) Notice: Subject to any disclaimer, the term of this patent is extended or adjusted under 35 U.S.C. 154(b) by 136 days.

(21) Appl. No.: 11/084,145

(22) Filed: Mar. 21, 2005

(65) Prior Publication Data

US 2006/0107626 A1 May 25, 2006

Related U.S. Application Data

(60) Provisional application No. 60/629,554, filed on Nov. 22, 2004.

(51) Int. Cl.
*B68C 1/02* (2006.01)

(52) U.S. Cl. ..... 54/44.1

(58) Field of Classification Search ..... 54/44.1, 54/71; 119/770, 771; 70/14, 16, 18, 19, 70/24

See application file for complete search history.

(56) References Cited

U.S. PATENT DOCUMENTS

| | | | | |
|---|---|---|---|---|
| 5,029,434 | A * | 7/1991 | Erickson | 54/44.1 |
| 5,159,728 | A * | 11/1992 | Bingold | 70/16 |
| 5,423,292 | A * | 6/1995 | Hall | 119/770 |
| 5,901,531 | A * | 5/1999 | Rogers | 54/44.1 |
| 6,047,665 | A * | 4/2000 | Deveaux | 119/770 |
| 6,553,944 | B1 * | 4/2003 | Allen et al. | 119/770 |
| 7,021,037 | B1 * | 4/2006 | Szymas | 54/44.1 |

* cited by examiner

*Primary Examiner*—Thomas Price
(74) *Attorney, Agent, or Firm*—William L. Klima; Klima Law Offices, PLLC

(57) ABSTRACT

An equestrian tattletale rider hand-training device including a left wrist strap releaseably connected to a right wrist strap, and the wrist straps releaseably connected to the saddle.

9 Claims, 5 Drawing Sheets

EQUESTARIAN TATTLETALE RIDER HAND TRAINING DEVICE

CONTINUING INFORMATION

This application is based on the Provisional Application No. 60/629,554 filed on Nov. 22, 2004.

FIELD OF THE INVENTION

The present invention is directed to an equestrian tattletale rider hand-training device for use by an equestrian rider.

BACKGROUND OF THE INVENTION

Currently, the equestrian riders spend much time training to improve riding skills and developing more effective aids (i.e. signals given by the rider to the horse via hands, voice and/or legs). A key aspect of proper training involves the positioning and use of the rider's hands. The position, timing, amount of pressure applied by the rider's hands to the reins, onto the bit, directly communicate commands from the rider to the horse's mouth. It is the desire and will of most equestrians to achieve a harmonious and elastic connection through an educated elastic and soft hand.

There exists a need for a training tool or device for quickly and properly training an equestrian rider with regards to the positioning and use of the rider's hands. The present invention is directed to a rider hand-training device capable of effectively and safely training the proper position and use of the rider's hands. The proper position of the hands also assists in a more effective and balanced seat and leg position, essential in horseback riding.

Further, the present invention provides a valuable tool for instructors because the student can feel instantly when mistakes are made thru resistance of the straps. The present invention should also help the overall soundness and attitude of the horse by reducing rein lamenesses.

SUMMARY OF THE INVENTION

A first object of the present invention is to provide an equestrian tattletale rider hand-training device.

A second object of the present invention is to provide an improved equestrian tattletale rider hand-training device.

A third object of the present invention is to provide an equestrian tattletale rider hand-training device including a pair of wrists straps releaseably connected together.

A fourth object of the present invention is to provide an equestrian tattletale rider hand-training device including a pair of wrist straps releaseably connected together by a releasable connector, preferably a hook and loop type fastener such as a Velcro type fastener.

A fifth object of the present invention is to provide an equestrian ride hand training device including a pair of adjustable wrist straps releaseably connected together by a Velcro type fastener, the wrist straps each including a saddle strap provided with releasable swivel snap.

The present invention is directed to an equestrian tattletale rider hand-training device. The hand-training device is configured to be worn by a rider during training for improved competition results, and clearer communication of the rider's aids to the horse for a more effective and harmonious relationship between horse and rider.

The hand-training device according to the present invention includes a pair of wrist straps releaseably connected together. The wrist straps can be releaseably connected together by a releasable fastener. A preferred releasable fastener is a hook and loop type fastener (e.g. Velcro type fastener) releaseably connecting the pair of wrist straps together.

In a more preferred embodiment, the wrist straps are adjustable in size to allow a rider to loosen the straps to fit over his or her hands, and then tighten to snuggly fit the wrist straps to the rider's wrists. For example, the wrist straps are adjustable in size by passing through a first slot in a two (2) slot slide buckle, and the second end passing through the second slot of the slide buckle and being provided with a Velcro fastener for releaseably securing same to another portion of the strap. The other end of the strap is provided with another Velcro type fastener for releaseably connecting with the other wrist strap. In addition, a saddle strap is provided through a slot in the slide buckle and releaseably connected to another portion of the saddle strap. The saddle strap is provided with a Velcro type fastener for releaseably connecting the portions of the saddle strap together. The saddle straps are provided with a releasable swivel snap.

The wrist straps have essentially the same construction except the wrist straps are releaseably connected together by a Velcro type fastener with a first part of the Velcro connected to the one wrist strap and the other part of the Velcro type fastener being connected to the other wrist strap. The releasable swivel snaps are configured to releaseably connect the rider hand-training device to the rider's saddle.

DETAILED DESCRIPTION OF PREFERRED EMBODIMENTS

Figure 1:
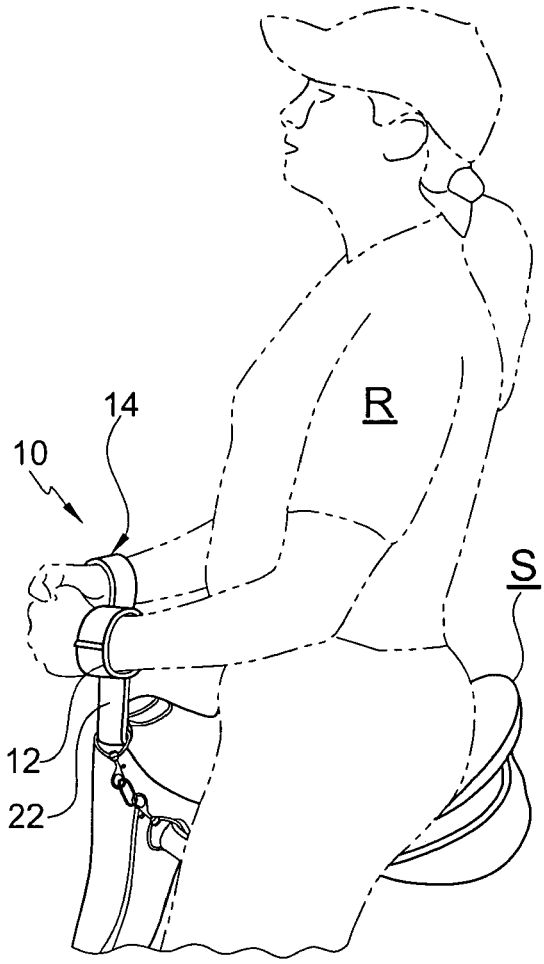
FIG. 1 is a side elevational view showing an equestrian rider wearing a preferred embodiment of the equestrian tattletale rider hand-training device according to the present invention.
Figure 2:
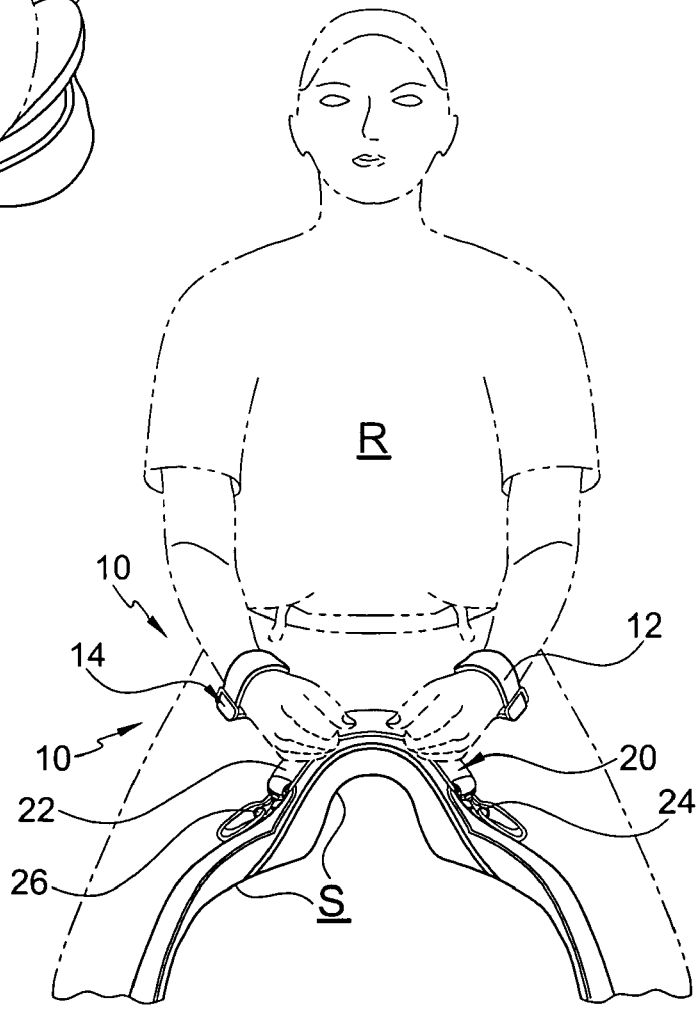
FIG. 2 is a front elevational view of the equestrian rider wearing the equestrian tattletale rider hand-training device, as shown in FIG. 1.
Figure 3:
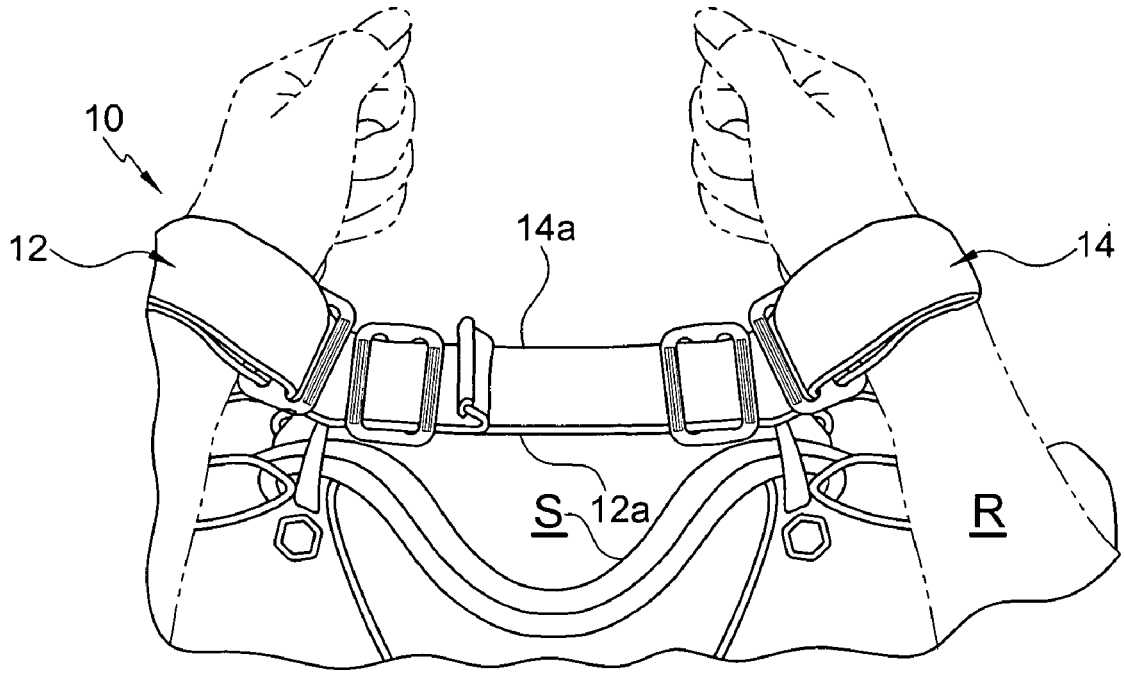
FIG. 3 is a partial top planar view of the equestrian rider wearing the equestrian tattletale rider hand-training device, as shown in FIGS. 1 and 2.

An equestrian tattletale rider hand-training device 10 according to the present invention is shown being worn by an equestrian rider in FIGS. 1–3.

Figure 4:
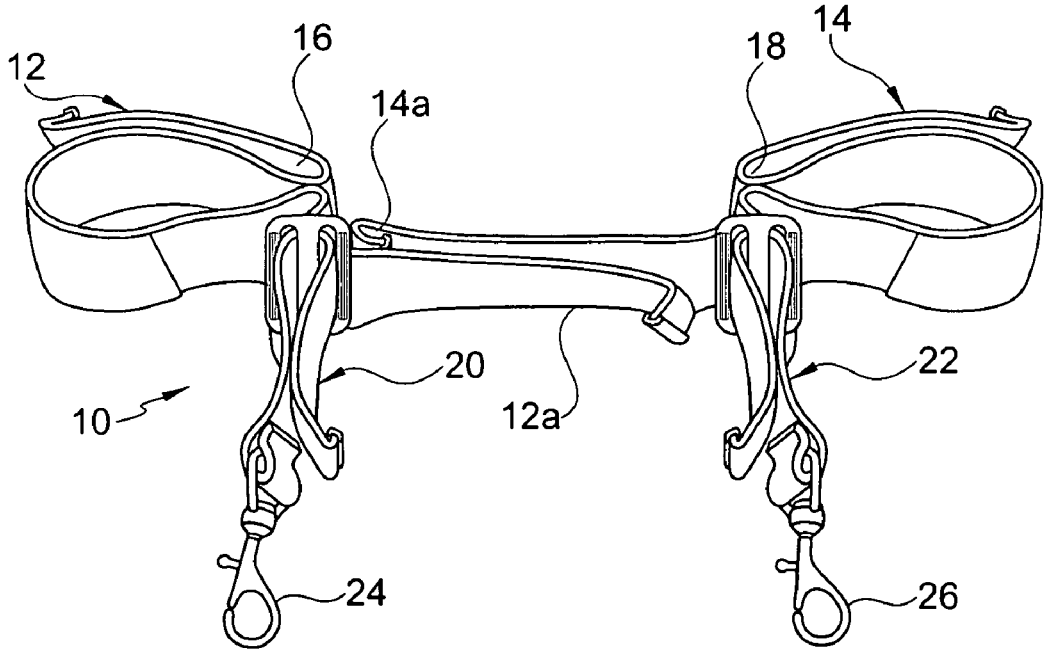
FIG. 4 is a perspective view of the equestrian tattletale rider hand-training device, not worn and assembled, as shown in FIGS. 1–3.

The hand-training device 10 includes a left wrist strap 12 and a right wrist strap 14. As shown in FIG. 4, a first end 12*a* of the left wrist strap 12 is releaseably connected to the first end 14*a* of the right wrist strap 14. The details of the releasable connection between the left wrist strap 12 and right wrist 14 will be discussed in detail below.

The left wrist strap 12 is provided with a slide buckle 16 for adjusting the size of the left wrist strap 12. The right wrist strap 14 is provided with a slide buckle 18 to allow the size of the right wrist strap 14 to be adjusted in size. The details of the adjustable size wrist straps 12, 14 will be discussed in detail below.

Figure 5:
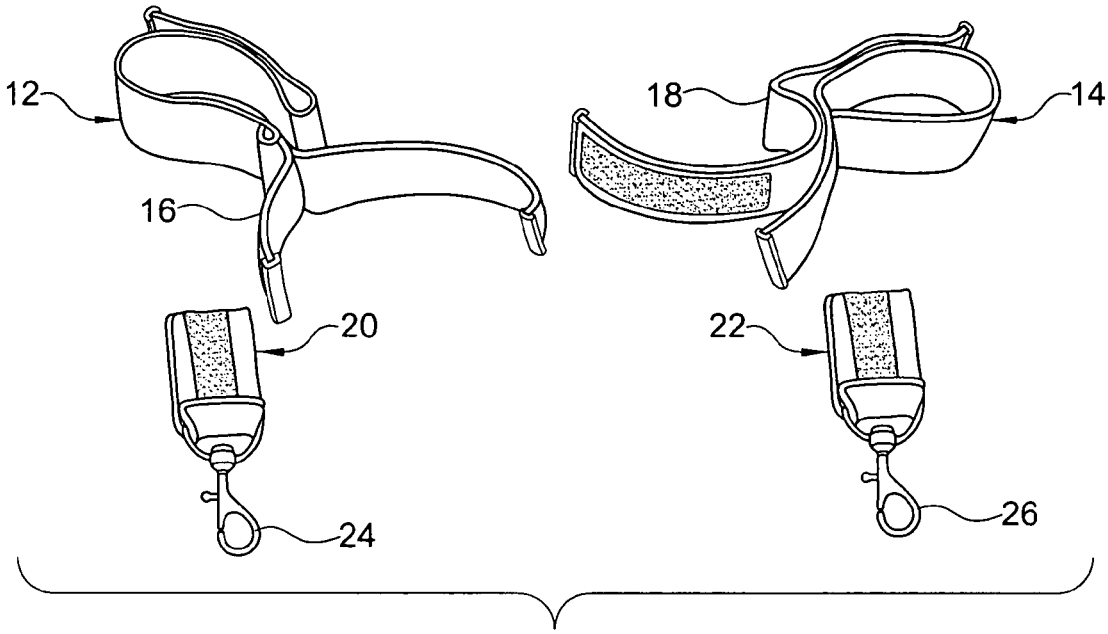
FIG. 5 is a perspective view of the equestrian tattletale rider hand-training device, not worn and disassembled, as shown in FIGS. 1–3.
Figure 6:
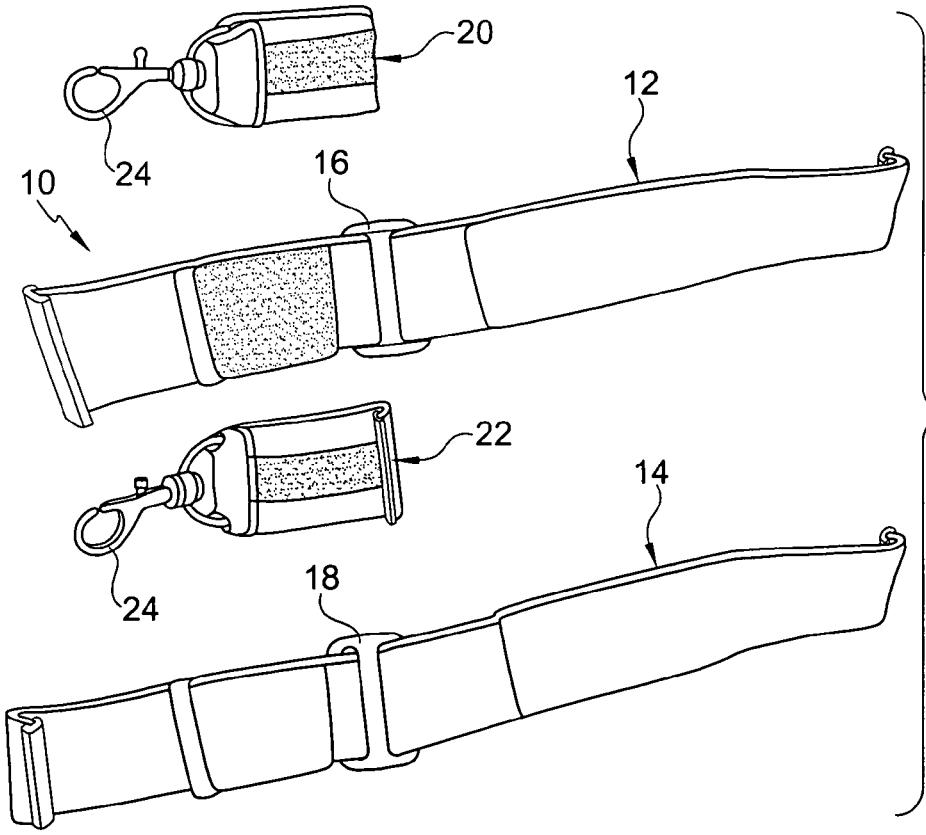
FIG. 6 is a perspective view of the equestrian tattletale rider hand-training device, not worn and disassembled in pieces, as shown in FIGS. 1–3.

The left wrist strap 12 is releaseably connected to a left saddle strap 20 and the right wrist strap 14 is releaseably connected to a saddle strap 22, as shown in FIGS. 5 and 6. The details of the releasable connection between the wrist straps 12, 14 and the saddle straps 20, 22 will be discussed in detail below. The left saddle strap 20 is provided with a swivel strap 24 and the right saddle strap 22 is provided with a swivel snap 26. The details of the connection between the saddle straps 20, 22 and the swivel snaps 24, 26 will be discussed in detail below.

Figure 7:
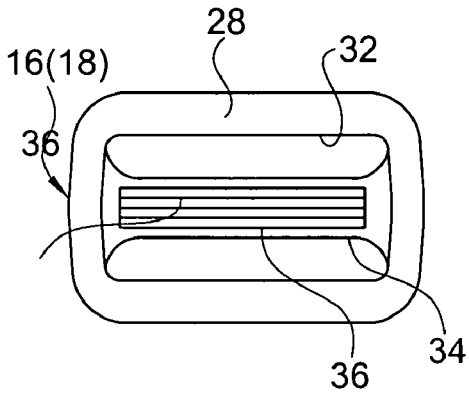
FIG. 7 is a top planar view of a slide buckle portion of the equestrian tattletale rider hand-training device, as shown in FIGS. 1–3.
Figure 8:
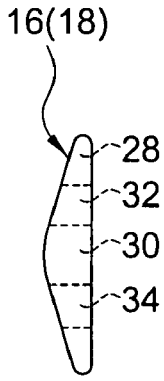
FIG. 8 is a side elevational view of the slide buckle shown in FIG. 7.
Figure 9:
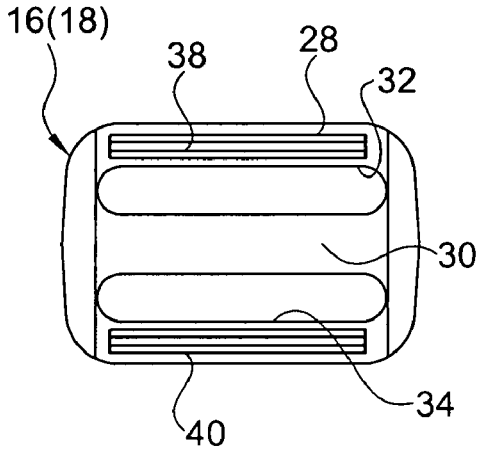
FIG. 9 is a bottom planar view of the slide buckle shown in FIGS. 7 and 8.

Detailed views of the slide buckle 16 (18) are shown in FIGS. 7–9.

The slide buckle 16 (18) is provided with an outer frame 28 having a divider 30 defining a pair of through slots 32, 34. The through slots 32, 34 are configured to accommodate the wrist strap 12 or 14. The front side of the slide buckle 18 is provided with a series of parallel and raised friction ribs 36 and the back side of the slide buckle is provided with two series of parallel and raised friction ribs 38, 40. The ribs 36, 38, 40 are configured to increase the friction between the slide buckle 18 and the wrist straps 12, 14, and grip same to prevent slippage of the wrist straps 12, 14 relative to the slide buckles 16, 16 during use.

Figure 10:
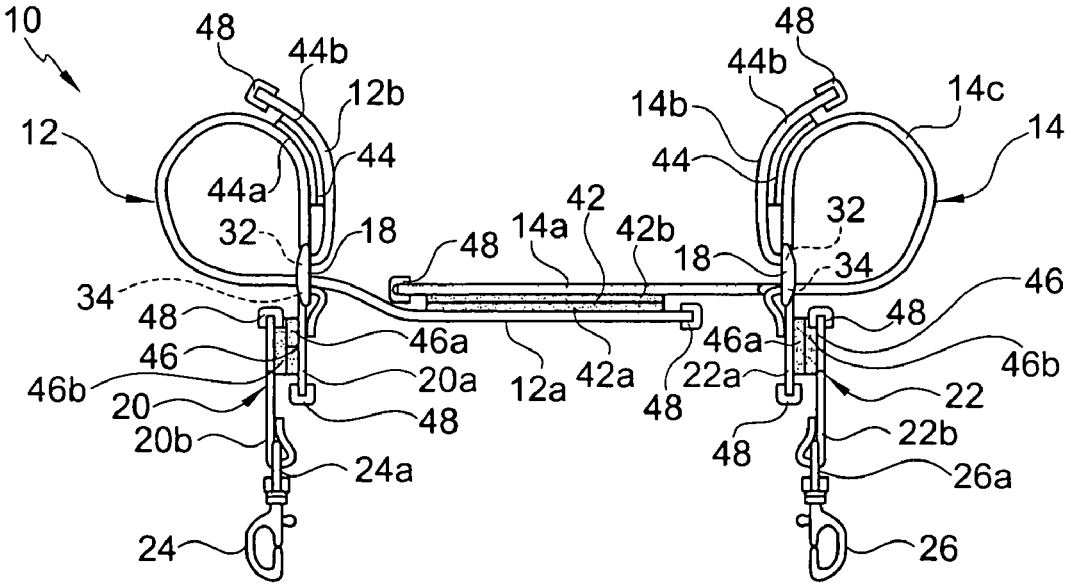
FIG. 10 is a side elevational view of the equestrian tattletale rider hand-training device, assembled, as shown in FIG. 1–3.

A detailed view of the hand-training device 10 is shown in FIG. 10.

The first end 12*a* of the left wrist strap 12 is releaseably connected to the first end 14*a* of the right wrist strap 14 by a releasable fastener 42. The releasable fastener 42 can be a mechanical fastener (e.g. snap, zipper, clasp, rivet), or more preferably by a hook and loop type fastener (e.g. Velcro type fastener). Specifically, a first part 42*a* of the releasable fastener 42 is connected to the first end portion 12*a* of left wrist strap 12, and a second part 42*b* of the releasable fastener 42 is connected to the first end portion 12*a* of right wrist strap 14.

The second end portion 12*b* of the left wrist strap 12 and the second end portion 14*b* of the right wrist strap 14 are each provided with a releasable fastener 44. Specifically, a first part of the releasable fastener 44 is connected to the second end portions 12*b*, 14*b* of the wrist straps 12, 14, respectively, which releaseably connect with second parts of the releasable fasteners 44, which are attached to middle cuff portions 12*c*, 14*c* of the wrist straps 12, 14, respectively.

First end portions 20*a*, 22*a* of the saddle straps 20, 22, respectively, are releaseably connected to second end portions 20*b*, 22*b* of the saddle straps by releasable fastener 46. Specifically, first parts 46*a* of the releasable fasteners 46 are connected to first end portions 20*a*, 22*a* of saddle straps 20, 22, respectively, and second parts 46*b* of the releasable fasteners 46 are connected to second end portions 20*b*, 22*b* of the saddle straps 20, 22.

The second end portions 12*b*, 14*b* of the wrist straps 12, 14, respectively, are inserted through the upper slots 32 of the slide buckles 16, 18, and then folded backwards over the outer surface of the middle cuff portions 12*c*, 14*c*, as shown in FIG. 10. First parts 44*a* of the releasable fasteners 44 are connected to the outer surface of the middle cuff portions 12*c*, 14*c*, and the second parts 44*b* of the releasable fasteners 44 are connected to the inner surface of the second end portions 12*b*, 14*b* of the wrist straps 12, 14, respectively. This arrangement allows the size of the wrist straps 12, 14 to be adjusted by disconnecting the second ends 12*b*, 14*b* of the wrist straps 12, 14 from the middle cuff portions 12*c*, 14*c* allowing the wrist straps 12, 14 to slide through the slots 32 in the buckles 16, 18, and then reattaching the second ends 12*b*, 14*b* of the wrist straps 12, 14 to the middle cuff portions 12*c*, 14*c*. In this manner the size of the wrist straps 12*c*, 14*c* can be resized or readjusted at any time desired by the rider.

The releasable fastener 42 includes a first part 42*a* connected to the first end of 12*a* of the left wrist strap 12 and a second part 42*b* connected to the first end 14*a* of the right wrist strap 14. Further, first parts 46*a* of releasable fasteners 46 are connected to the first end portions 20*a*, 22*a* of the saddle straps 20, 22, respectively, and second parts 46*b* of the releasable fasteners 46 are connected to the second end portions 20*b*, 22*b*, respectively, of the saddle straps 20, 22.

The first end portions 20*a*, 22*b* of the saddle straps 20, 22, respectively, are threaded through the lower slots 34 of the buckles 16, 18 and folded over and sewn to the saddle straps 20, 22 to connect the saddle 20, 22 to the slide buckles 16, 18. Further, the second end portions 20*b*, 22*b* of the saddle straps 20, 22, respectively, are threaded through loop portions 24*a*, 26*a* of swivel snaps 24, 26, respectively, and folded back onto and sewn to the saddle straps 20, 22 to connect the swivel snaps 24, 26 to the saddle straps 20, 22, respectively.

The wrist straps 12, 14 and saddle straps 20, 22 are preferably made from the same stock fabric strap material, (e.g. polyester, nylon, blend, composite), and cut to length during fabrication of the hand-training device 10. In a preferred embodiment, the releasable fasteners 42, 44, 46 are hook and loop type fasteners (e.g. Velcro) with a first part and second part of each Velcro fastener sewn to the wrist straps 12, 14 and saddle straps 20, 22 at the appropriate locations. Further, the saddle straps 20, 22 are threaded through the slots 34 as shown in FIG. 10, and the saddle straps 20, 22 are permanently connected to the slide buckle 18 by threading the second end portions 20*a*, 22*a* of the saddle straps 20, 22 through the slots 34, and then folding over and sewing as shown in FIG. 10. Further the swivel snaps 24, 26 are permanently attached to the second end portions 20*b*, 22*b* of the saddle straps 20, 22, respectively, by threading the second end portions 20*b*, 22*b* through the loop portions 24*a*, 26*a* of the snap swivels 24, 26, respectively, and then folding over and sewing as shown in FIG. 10. In order to prevent the exposed ends of the wrist straps 12, 14 and saddle straps 20, 22 to fray or unravel, the end portions thereof are wrapped and sewn by fabric end cover portions 48.

Figure 11:
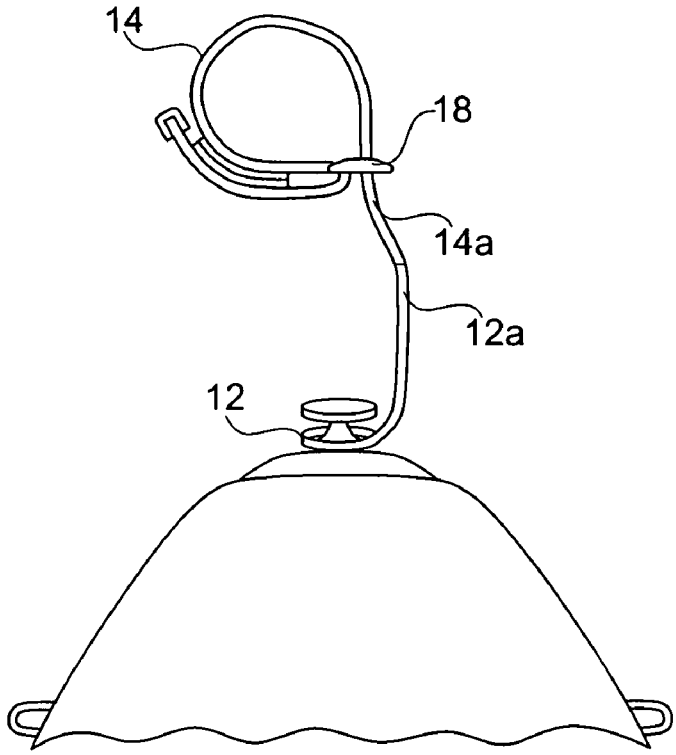
FIG. 11 is a diagrammatic front view of a first Western conversion of the equestrian tattletale rider hand-training device.
Figure 12:
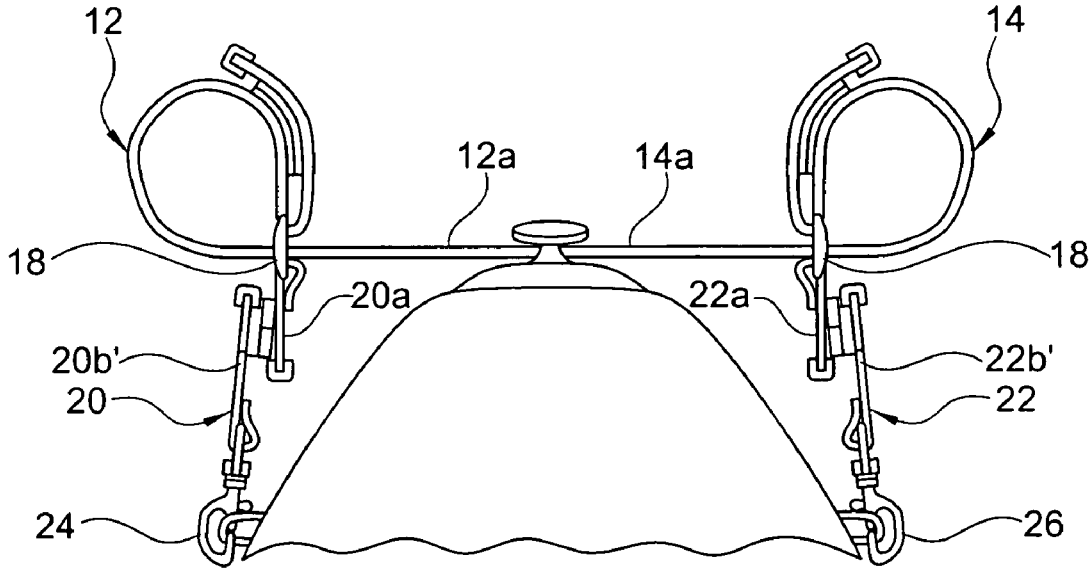
FIG. 12 is a diagrammatic front view of a second Western conversion of the equestrian tattletale rider hand-training device.

A first and second Western conversion of the equestrian tattletale rider hand-training device is shown in FIGS. 11 and 12.

In the first Western conversion shown in FIG. 11, one of the wrist straps 12 or 14 is placed around the saddle horn. In the second Western conversion shown in FIG. 12, the saddle straps 20, 22 are lengthened versus the English setup.

OPERATION OF USE

The equestrian tattletale rider hand-training device 10 according to the present invention is worn on the wrists of an equestrian rider R, as shown in FIGS. 1–3.

The hand-training device 10 is fitted onto the rider's wrists by initially opening the wrist straps 12, 14 by pulling the first end portions 12*b*, 14*b* of the wrist straps 12, 14 away from the middle cuff portions 12*c*, 14*c* so as to separate the first parts 44*a* from the second parts 44*b* of the releasable fasteners 44. The middle cuff portions 12*c*, 14*c* are increased in size by pulling on the wrist straps 12, 14 at the location of the middle cuff portions 12*c*, 14*c* to make the middle cuff portions 12*c*, 14*c* larger. Alternatively, the middle cuff portions 12*c*, 14*c* are made smaller by pulling on the second end portions 12*b*, 14*b* of the wrists straps 12, 14, respectively. To put on the hand-training device 10, the wrist straps 12, 14 are initially enlarged to allow the hands of the rider to fit through the middle cuff portions 12*c*, 14*c*. Then, the second end portions 12*b*, 14*b* of the wrist straps 12, 14, respectively, are pulled to tighten the middle cuff portions 12*c*, 14*c* to snuggly fit around the wrists of the rider, and then the second ends portions 12*b*, 14*b* are secured by the releasable fasteners 44 by pulling the second end portions 12*b*, 14*b* towards the middle cuff portions 12*c*, 14*c* so that the first parts 44*a* contact with the second parts 44*b* of the releasable fasteners 44.

The wrist straps 12, 14 can be connected together by releasable fastener 42 prior to the hand-training device 10 being placed on the wrists of the rider. Alternatively, the wrist straps 12, 14 can be disconnected when fitted on the wrists of the rider, and then connected together by the releasable fastener 42. Preferably, the saddle straps 20, 22 are already connected to the wrist straps 12, 14 by releasable fasteners 46 prior to being placed on the wrists of the rider.

The rider can wear the hand-training device 10 before mounting a horse, preferably with the wrist straps 12, 14 disconnected, or can initially mount the horse and then fit on the hand-training device 10. Once the rider is mounted on the horse and is wearing the hand-training device 10, the saddle straps 20, 22 are connected to D-rings on the saddle S by swivel snaps 24, 26.

While riding the horse, the rider's hands are held in the proper location and manner by the hand-training device 10. In the event while riding that the rider needs to immediately separate his or her hands, when an ample amount of force is applied by the wrists of the rider onto the wrist straps 12, 14, the releasable fastener 42 will disconnect. Further, in the event the rider needs to release his or her hands from the D-rings of the saddle S, the wrist straps 12, 14 may also be separated from the saddle straps 20, 22 when enough pressure is applied to release same. At the end of the riding session, the rider can release and disconnect or completely remove the hand-training device 10 prior to dismounting, or after dismounting the horse. Again, the rider may desire to separate the wrist straps 12, 14 and the saddle straps 20, 22 prior to dismounting the horse when wearing the wrist straps 12, 14 while dismounting. The rider will need to disconnect the saddle straps from the D-rings of the saddle before dismounting.

I claim:

1. An equestrian tattletale rider hand-training device, said device comprising:

a first wrist strap releaseably connected to a second wrist strap, said first wrist strap and said second wrist strap each including:

a slide buckle having an outer frame and a center divider defining two (2) slots, said wrist strap having a first end portion and a second end portion threaded through said two (2) slots of said slide buckle from one side of said slide buckle to define a center wrist cuff portion, said first end portion of said strap wrapping around an upper side of said outer frame of said slide buckle and being releaseably connected to an outer surface of said center wrist cuff portion to allow the size of the center wrist cuff portion to be adjustable in size;

a saddle strap having a first end connected to a lower side of said outer frame of said slide buckle;

a releasable swivel snap connected to a lower end of said saddle strap;

a first hook and loop type fastener provided between a first end portion of said wrist strap and a first end portion of said second wrist strap to releasably connect said first wrist strap to said second wrist strap;

a second hook and loop type fastener provided between said first end of said wrist strap and said center wrist cuff portion to releaseably connect said first end portion of said wrist strap to said center cuff portion of said wrist strap and allow the size of the center wrist cuff portion to be adjustable in size; and a third hook and loop type fastener provided between a first portion and second portion of said saddle strap to releaseably connect said first portion of said saddle strap to a second portion of said saddle strap and to releaseably connect said device to the saddle.

2. A device according to claim 1, wherein said wrist straps are made of an elastic or stretch fabric material, and said first, second and third hook and loop fasteners each include a hoop portion and loop portion sewn to said fabric material.

3. A device according to claim 1, wherein said first end of said wrist strap portion is provided with a hook portion adjacent a loop portion on a first side of said wrist strap, and said first end of said wrist strap is folded over said first side of said outer frame of said slide buckle so that said hoop portion releaseably connects with said hook portion and to provide an adjustable size middle cuff portion of said wrist strap.

4. A device according to claim 3, wherein said wrist straps are made of a fabric material, and said first, second and third hook and loop fasteners each include a hoop portion and loop portion sewn to said fabric material.

5. A device according to claim 3, wherein said saddle strap is connected to said second side of said outer frame of said slide buckle by wrapping said first end of said saddle strap around said second side of said outer frame of said slide buckle, and sewing said first end of said saddle strap to an adjacent portion of said saddle strap at a position adjacent to said second side of said outer frame of said slide buckle.

6. A device according to claim 5, wherein said wrist strap is sewn to said saddle strap at said position adjacent to said second side of said outer frame of said slide buckle.

7. A device according to claim 1, wherein said saddle strap is connected to said second side of said Outer frame of said slide buckle by wrapping said first end of said saddle strap around said second side of said outer frame of said slide buckle, and sewing said first end of said saddle strap to an adjacent portion of said saddle strap at a position adjacent to said second side of said outer frame of said slide buckle.

8. A device according to claim 7, wherein said wrist strap is sewn to said saddle strap at said position adjacent to said second side of said outer frame of said slide buckle.

9. A device according to claim 1, wherein said swivel snap is provided with a loop type connector, and a second end of said saddle strap is connected to said loop type connector by wrapping said second end of said saddle strap around said loop type connector of said swivel snap and sewing said second end of said saddle strap to an adjacent portion of said saddle strap at a position adjacent to said loop type connector.

* * * * *